United States Patent [19]

Rishworth et al.

[11] Patent Number: 5,049,088

[45] Date of Patent: Sep. 17, 1991

[54] MULTI CONDUCTOR ELECTRICAL CABLE CONNECTOR

[75] Inventors: Paul L. Rishworth, Bellevue; Denis L. Rishworth, Knysna Heights, both of South Africa; Daniel A. Dixon, Naperville, Ill.

[73] Assignee: Molex Incorporated, Lisle, Ill.

[21] Appl. No.: 622,457

[22] Filed: Dec. 5, 1990

Related U.S. Application Data

[63] Continuation-in-part of Ser. No. 479,302, Feb. 7, 1990, Pat. No. 5,009,612.

[51] Int. Cl.[5] ..... H01R 4/24

[52] U.S. Cl. ..... 439/417

[58] Field of Search ..... 439/389–425

[56] References Cited

U.S. PATENT DOCUMENTS

| | | | |
|---|---|---|---|
| 4,691,977 | 9/1987 | Marzili et al. | 439/417 |
| 4,723,918 | 2/1988 | Lacroix | 439/417 |
| 4,891,018 | 1/1990 | Afferbaugh et al. | 439/417 |

*Primary Examiner*—Joseph H. McGlynn

*Attorney, Agent, or Firm*—Louis A. Hecht; Stephen Z. Weiss; Charles S. Cohen

[57] ABSTRACT

Connectors for field terminating ribbons cables are provided. The connector includes a nonconductive housing having a bottom wall and upstanding side walls extending therefrom to define an open topped termination cavity. A plurality of insulation displacement terminals are frictionally retained in the housing to extend through the bottom wall and into the termination cavity. A flowable sealing grease may be disposed in the termination cavity substantially surrounding the terminals therein. One wall of the housing includes a slot for receiving the ribbon cable in register with the terminals of the connector. A press member is frictionally retained in the housing in a pre-load condition and can be urged into a fully seated locked condition where the press member urges the ribbon cable toward the bottom wall of the housing and into engagement with the terminals therein. The movement of the press member into the housing causes the sealing grease to fill voids surrounding the terminals and the ribbon cable for efficient environmental sealing.

8 Claims, 4 Drawing Sheets

MULTI CONDUCTOR ELECTRICAL CABLE CONNECTOR

RELATED APPLICATIONS

This application is a continuation-in-part of pending U.S. Patent Application Ser. No. 479,302 which was filed on Feb. 7, 1990, now U.S. Pat. No. 5,009,612.

FIELD OF THE INVENTION

This invention relates to an electrical conductor connector for connecting the conductors of electrical cables to terminals and more particularly to a connector for terminating the conductors of multi-strand ribbon tape cables to insulation displacement terminals.

BACKGROUND OF THE INVENTION

Electrical conductor connectors for terminating ribbon cables are well known. Many of the known connectors such as those disclosed in U.S. Pat. No. 4,552,429, U.S. Pat. No. 4,621,885, U.S. Pat. No. 4,668,039, U.S. Pat. No. 4,697,862, U.S. Pat. No. 4,713,025, U.S. Pat. No. 4,753,600, European Patent No. 0150593 and Canadian Patent No. 1070403 include terminal carriers which have a removable cover Which is, in one way or another, engaged with the terminal carrier to hold conductors in the connector in engagement with the terminals of the terminal carrier. Problems that frequently arise with conductor connectors of the above type are that the conductors, whether single conductors or contained in ribbon tapes, may easily be torn from the terminals in the connectors by stress applied to the conductors on the outside of the connector with which they are engaged to cause electrical disconnection of the conductors with the terminals and more often than not irreparable damage to the terminals themselves. A second problem with the known conductor connectors is that the covers for holding the conductors on the terminal carriers are components which are separate from the carriers and so easily become misplaced and prior to location over conductors engaged with the carrier terminals permit, in hostile environmental conditions such as in mines and in many industrial applications, the ingress of particulate matter and other dirt onto or into the terminal carriers with the possible consequence that the covers may be improperly located and in time become dislodged from the terminal carriers and further that the dirt may interfere with the proper electrical connection of the conductors with the terminals on those connectors in which the covers press the conductors into electrical engagement with the terminals on the terminal carriers. Further ambient moisture may affect the connectors and may generate short circuits.

It is the object of this invention to provide an electrical conductor connector which will at least minimize the problems discussed above with known conductor connectors.

SUMMARY OF THE INVENTION

An electrical conductor cable connector according to the invention includes a housing, made from an electrical insulating material. The housing has side walls which between them define an enclosure. A floor extends between the side walls to define an open topped compartment in the housing on one side of the floor. A plurality of suitably spaced conductor engaging elements extend from the floor and into the compartment, with each element including a formation for electrically connecting an electrical conductor in a cable to the conductor engaging element. A press member made from an electrical insulating material is provided for pressing a conductor ribbon tape cable into the compartment, and for urging the conductor carried by the tape, into electrical engagement with the conductor engaging elements. The connector further includes means for clamping the ribbon tape in the compartment between the conductor engaging elements and a tape exit from the housing. A catch arrangement is provided for locking the press member in the compartment to hold the tape clamped in the housing.

Further according to the invention each conductor engaging element may include a first blade which extends perpendicularly from the housing floor into the compartment with the connecting formation on each conductor element being a second oppositely directed blade. Each blade of each conductor engaging element includes a cutting edge for cutting the ribbon tape insulation on a conductor when pressed onto the blade and a slot for electrically engaging a conductor in the insulation. The press member may include slots for receiving the blades when the ribbon tape is pressed by the press member into the compartment over the blades.

In one form of the invention the housing floor includes, on its side opposite to that in the compartment, a recess defining a second compartment into which the second blades of the conductor engaging elements project. This embodiment of the connector includes a second press member, having blade slots, for pressing a second conductor ribbon tape into the second compartment and the tape conductors into electrical engagement with the blade slots. A catch arrangement is provided for locking the second press member in the second compartment. Conveniently the second compartment includes clamping means for clamping the ribbon tape in the floor in a position between the conductor element blades in the second compartment and one or more tape exits from the compartment.

The ribbon tape clamping means may be mating tape direction changing formation between the housing in each compartment and the associated press member between which the/or each ribbon tape is clamped in use.

Still further according to the invention the catch arrangement for holding each press member in the associated compartment is a resiliently deformable male formation on a surface of one of the components and a recess in an adjacent surface of the other into which the male formation is pressed to lock the components together when the press member is fully pressed into the associated compartment.

In a preferred form of the invention of the housing includes a ribbon tape entry slot which extends through the wall of at least the first compartment above the conductor engaging elements and the cable connector includes a first catch arrangement for holding the press member in the compartment clear of the tape entry slot and a second catch arrangement for holding the press member in pressure contact with the tape when pressed into clamping contact with the tape.

Conveniently each housing compartment is filled with a flowable liquid sealant as, for example, sealing grease.

In many electrical circuit applications in which the cable connector will find application it will be convenient to open a conductor in the connector and the housing may, for this purpose, include a cutting blade which extends from the floor or press member into the compartment for cutting and so open circuiting a preselected cable conductor when pressed by the press member into the compartment with a conductor engaging element on at least one side of the cutting blade in the path of the cut conductor through the housing for electrically engaging the conductor on one side of the blade. Preferably, the base of the press member and the floor in the compartment which carries a cutting blade includes mating formations in the cut conductor path through the housing on one side of the cutting blade for deforming the cut conductor to shorten it out of electrical contact with the cutting blade.

BRIEF DESCRIPTION OF THE DRAWINGS

The invention is now described by way of example only with reference to the drawings in which.

DETAILED DESCRIPTION OF THE PREFERRED EMBODIMENT

Figure 1:
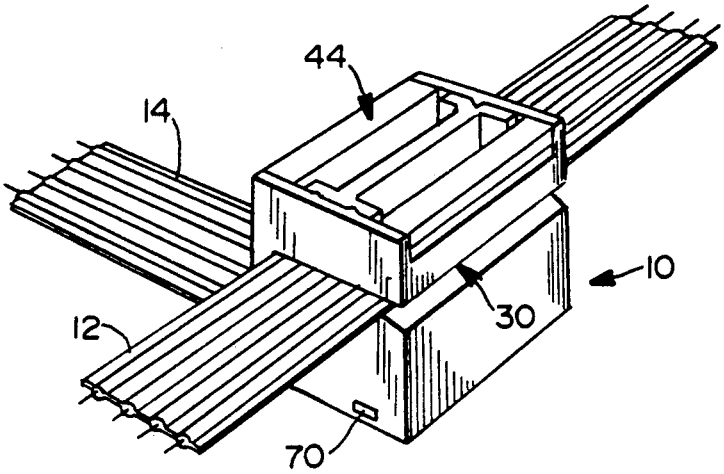
FIG. 1 is a perspective view of the electrical conductor cable connector of the invention shown connecting two ribbon tape cables at right angles to each other.

One embodiment of the cable connector 10 of the invention is shown in FIG. 1 to be connecting two multiconductor ribbon tape cables 12 and 14 at right angles to each other.

Figure 2:
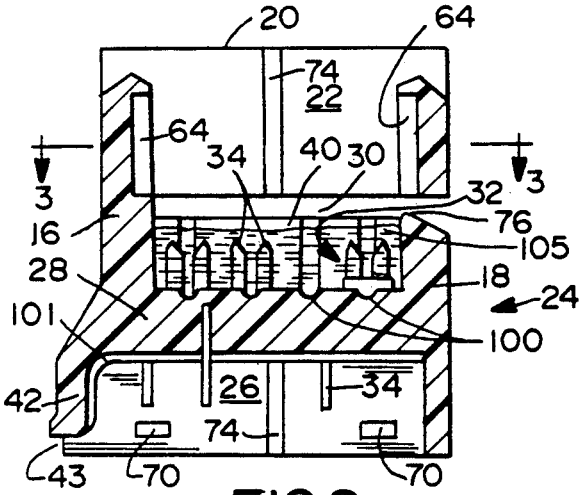
FIG. 2 is a sectioned side elevation of the connector housing shown sectioned on the line 2—2 in FIG. 3.
Figure 3:
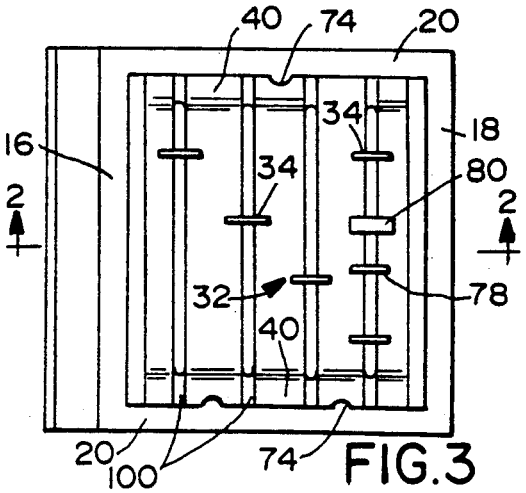
FIG. 3 is a plan view of the FIG. 2 housing shown sectioned on the line 3—3 in FIG. 2.

The housing of the connector 10 of FIG. 1 is shown in FIGS. 2 and 3 to include side walls 16 and 18, opposite end walls 20 with a compartment 22 defined between the four walls and a floor portion indicated generally at 24. The floor portion of the housing is recessed to provide a second compartment 26 which is located below and separated from the first compartment by a floor 28.

Figure 5:
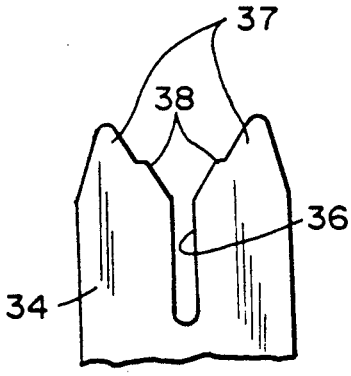
FIG. 5 is a fragmentary end elevation of the upper portion of one of the conductor connecting element blades of FIG. 4.
Figure 4:
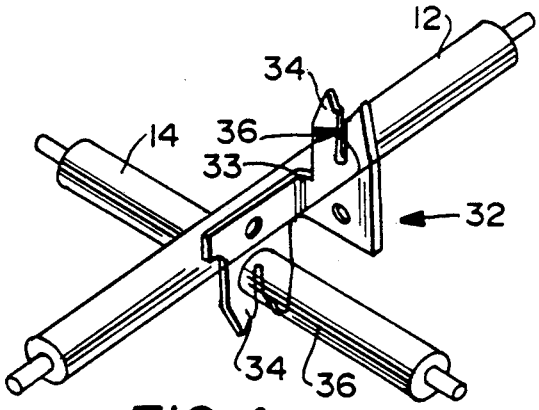
FIG. 4 is a partially ghosted perspective view of a single conductor connecting element of the connector of the invention shown connected to two insulated electrical conductors.

The walls 18 and 20 of the housing compartment 22 are slotted to provide an entry slot 30 for the ribbon tape A plurality of conductor engaging elements 32, which are more clearly seen in FIG. 4, each include two oppositely directed blades 34 which are joined at right angles to each other by a connector strip. The connector elements 32 are punched from a common strip of electrically conductive sheet metal such as a suitable cooper or brass alloy. As is more clearly seen in FIG. 5, the upper edge of each of the blades 34 includes spaced points for piercing the insulation of a ribbon tape on either side of one of the conductors of the tape, and defining a V-shaped formation for guiding the conductor into a slot 36 while at the same time slicing through the insulation on either side of the conductor. The width of the slot 36 is very slightly narrower than the diameter of the conductor so that the conductor in the cut insulation is in firm physical engagement with the blade 34 when fully pressed into the slot 36. The edges of the cable locating V could include small ripper teeth 38 to facilitate cutting of the ribbon tape insulation as a conductor is pressed into the slot 36 of the blades 34.

The central portion of the conductor engaging elements 32 including the connector strip between the blades is embedded in the material of the floor 28 with only the slotted portion of the blades 34 projecting from above and below the floor into the compartments 22 and 26 as shown in FIG. 2.

The conductor engaging elements 32, in the compartment 22, are each located across a groove in the floor which extends, up and over a rounded formation 40 in the end walls 20 to the slot 30. The grooves serve as locators for the conductor carrying portions of the ribbon tapes which are to be used with the connector. The floor of the compartment 26 is similarly grooved with the grooves running down and over a formation 42 which forms a side wall of the compartment to a tape outlet from the compartment.

Figure 6:
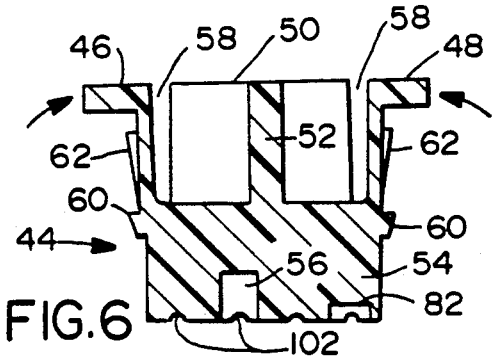
FIG. 6 is a sectioned side elevation of one of the press members for use with the housing of FIGS. 2 and 3.
Figure 7:
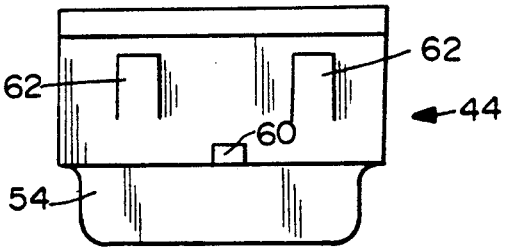
FIG. 7 is an end elevation of the press member of FIG. 6.

FIGS. 6 and 7 illustrate a press member 44 for use in pressing the ribbon tape 12 into the compartment 22 and into engagement with the conductor engaging elements 32 in the compartment. The press member is shown in the drawings to include side walls 46 and 48, opposite end walls 50 which are joined by a central rib 52 and a base portion 54.

The base 54 of the press member 44 is solid material and carries on its underside and its side walls grooves which, when the press member is located in the compartment 22 of the connector housing are in register with the locating grooves on the floor of the compartment and the formations 40 and slots 56 which are in register with the conductor engaging elements 32 on the floor of the compartment 22 and in which the blades of the elements are fully located when the press member is fully pressed into the compartment to clamp the ribbon tape 12 in the compartment. The side walls 46 and 48 of the press member are separated from the walls 50 by slots 58 which, together with the resilience of the plastics material from which the press member is made, enable the walls to be flexed inwardly towards the vertical edges of the walls 50 when the walls are pressed inwardly in the direction of the arrows in FIG. 6. Catch formations 60 and 62 are positioned on the outer surfaces of the side walls 46 and 48 as shown in FIG. 7. The inner surfaces of the side walls 16 and 18 of the connector housing are recessed at 64, as shown in FIG. 2, to receive the catches 60 and 62 of the press member.

Figure 8:
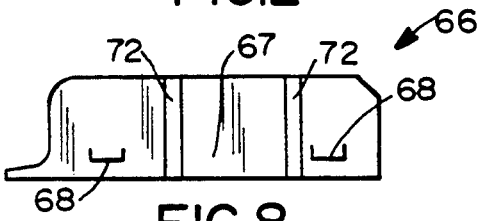
FIG. 8 is a side elevation of a second press member for use with the FIG. 2 and 3 housing.

FIG. 8 shows a second press member 66 for location in the compartment 26 of the floor portion 24 of the FIG. 2 housing. As is the case with the press member 44 of FIG. 6 conductor locating grooves extend over the upper surface of the press member 66 and over onto its left hand vertical edge in FIG. 8 and slots for receiving the blades 34 of the conductor engaging elements 32 in the compartment 26. The grooves in the press member are located to be in register with grooves on the underside of the floor 28 and the inner surface of the formation 42 in the compartment 26. The compartment 26 grooves, as with those on the upper surface of the floor, are in register with the slots in the blades 34 of the conductor engaging elements in the compartment. The end walls of the press member 66 include outwardly projecting catch formations 68 which, when the press member is fully pressed into the compartment 26 engage in slots 70 in the end walls of the compartment 26 to lock the press member in the compartment. This press member, as is the case with that of FIGS. 6 and 7, includes on one end wall two vertical grooves 72 and on the opposite end wall a single centrally located groove, not shown. The purpose of the grooves on the two press members is to ensure that the press members and the slots 56 in the them for receiving the conductor engaging blades 34 are correctly oriented by keying with inwardly projecting ribs 74 on the inner surfaces of the end walls of the compartments 22 and 26.

In use, the compartments 22 and 26 of the connector 10 are at least partially filled with a water resistant highly viscous grease. The ribbon tape 14 is located in the compartment 26 with its free end up against the wall on the right hand side of the compartment. The width of the compartment 26 conveniently corresponds to that of the ribbon tape 14 so that the raised conductor carrying portions of the ribbon tape insulation are located over the grooves and conductor engaging element blades 32 in the compartment. Alternatively, the compartment could be wider than the tape 14 but would then include one or more stops on the underside of the floor 28 accurately to locate the tape 14. The press member 66 is now located over the mouth of the recess 26 with the grooves 72 engaged with the locating ribs 74 on the inner surfaces of the end walls of the compartment. The press member is now pressed, conveniently by a suitable tool, into the compartment to press the ribbon tape 14 down over the blades 34 which cut through the insulation on the sides of the conductors in the tape and press the conductors into the slots 36 in the blades. The catch formations 68 on the ends of the press member are pressed, by resilient deformation of the catch formations and/or deformation of the walls 20 over the inner surfaces of the recess end walls until they clip into the slots 70 with the upper surface of the press member bearing on the ribbon tape 14. The raised conductor insulation of the tape 14 is now firmly located in the grooves in the compartment floor and in the press member. The formation 42 is dimensioned to be almost a friction fit with the left hand vertical side wall of the press member so that the ribbon tape is firmly pressure clamped in the compartment between the vertical side of the press member and the formation 42 to lock the ribbon tape in the compartment against any stress applied to the ribbon tape on the outside of the cable connector 10.

Figure 10:
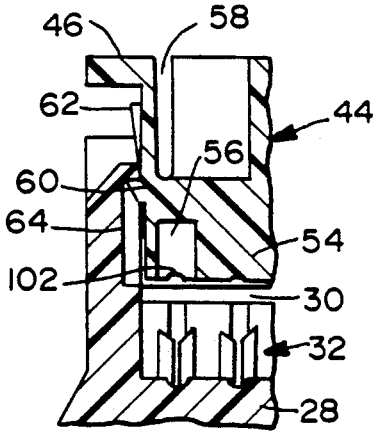
FIG. 10 is a fragmentary sectioned side elevation illustrating the first stage of engagement of the FIG. 6 press member with the FIG. 2 housing.

With the ribbon tape 14 now located in the compartment 26 and its conductors in electrical contact with the conductor engaging element blades 34 in that compartment the press member 44 is pressed into the recess 22 of the housing until its catches 60, again by resilient deformation of the material of the press member, engage in the recesses 64 in the walls 16 and 18 of the housing. With the catches 60 so engaged in the recesses the underside of the base 54 of the press member is situated above the upper edge of the slot 30 in the housing walls as shown in FIG. 10.

Figure 9:
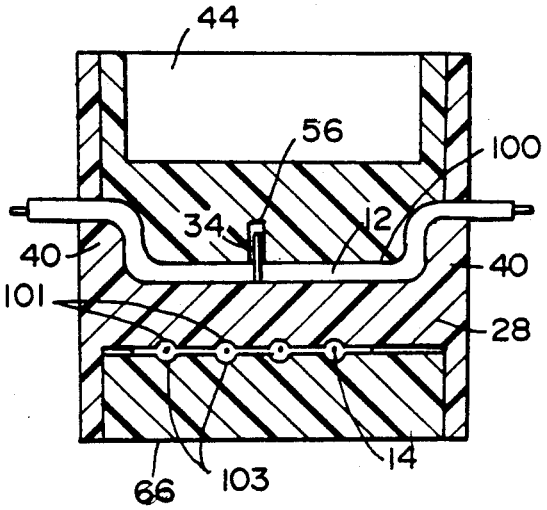
FIG. 9 is a sectioned end elevation of the cable connector of the invention in use.

At its place of use the ribbon tape 12, to which one or more of the connectors 10 are to be connected, is slid sideways into the slot 30 until its leading edge abuts the end of the slot 30 in the compartment 22. The entrance to the compartment could, as shown in FIG. 2, include a flared mouth which terminates in a very slightly raised projection 76 over which the ribbon tape 12 is frictionally moved into the slot 32 and which, once in the slot, engages the outer edge of the tape 12 accurately to locate the tape in the slot 30 with its raised conductor insulation over the grooves in the floor of the compartment and on the underside of the base 54 of the press member. As has been mentioned previously, the grooves 72 in the press member which are keyed with the ribs 74 on the end walls 20 of the compartment ensure that the slots 56 in the base of the press member are located directly over the blades of the conductor engaging elements 32 in the compartment. The press member 44 is now pressed downwardly into the compartment 22 with the side walls 46 and 48 hinging inwardly to permit the catches 62 to engage in the recesses 64 in the side walls of the housing to lock the press member in the housing in pressure contact with the ribbon tape 12. The ribbon tape conductors, as described with reference to the compartment 26, are now firmly located in the slots 36 of the blades 34 in the compartment 22. As will be seen from FIGS. 7 and 9 the side walls of the base 54 of the press member are rounded complementally to the formations 40 in the compartment 22. The side walls of the press member base are dimensioned, as is the case with the formation 42 of the compartment 26, to clamp the ribbon tape firmly between the press member and the vertical portions of the formations 40 against movement in the compartment by stress imposed on the ribbon tape 12 on the outside of the connector. This is illustrated in FIG. 9 which more clearly illustrates the direction changing clamping formations on both the housing and press member 44.

To release the cable connector of the invention from the ribbon tape 12 the side walls of the press member 44 are pressed inwardly in the direction of the arrows in FIG. 6 to clear the catches 62 of the recesses 64 in the walls 16 and 18 of the housing and, when cleared, the press member is merely lifted in the compartment 22 until the catches 60 abut the upper edges of the recesses 64. The ribbon tape 12 may then merely be tensioned to lift it from the conductor engaging element blades 34 and, when straightened, is merely slid from the slot 30 in the connector housing.

Figure 11:
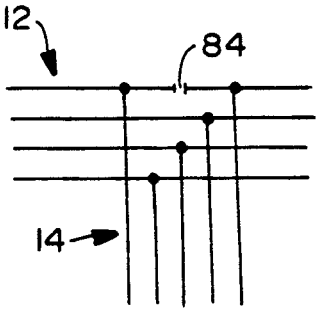
FIG. 11 is a schematic electrical diagram illustrating the function of the cable connector of the invention.
Figure 12:
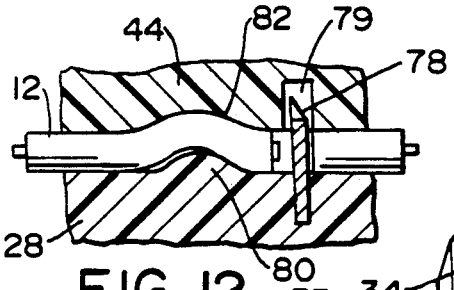
FIG. 12 is a fragmentary sectioned end elevation of a cable cutting blade arrangement in the connector housing.

In some applications, it may be desirable to open circuit one of the ribbon tape conductors in the connector as illustrated in FIG. 11. To achieve this, as shown in FIGS. 2, 3 and 12, a blade 78 is embedded in the floor 28 of the housing to project into one of the compartments, in this case compartment 22, with its sharpened upper edge projecting into the compartment. The press member 44 includes a recess for receiving the sharpened edge of the blade in use as illustrated in FIG. 12. The blade 78 is located in the conductor path between two blades 34 of linearly spaced conductor engaging elements 32 with a raised formation 80 on the floor 28 extending across the conductor insulation groove between the blade 78 and one of the blades 34. The underside of the press member 44 includes a complementally shaped female formation 82, as shown in FIGS. 2 and 6, in which the formation 80 is located in use. As the press member 44 now presses the ribbon tape 12 down onto the floor of the compartment 22 the blade 78 severs the conductor in whose path it lies with the conductor being deformed and so shortened by the formations 80 and 82 out of electrical contact with the blade 78 to ensure a clean open circuit 84 as shown in FIG. 11. The open conductor on either side of the break is now connected, through the blades 34 on either side of the cutting blade 78, to conductors on the ribbon tape 14. It will be noticed from FIG. 11 that the ribbon tape 14 in this drawing includes five conductors whereas the connector, as shown in the remaining drawings, has provision only for four. This is not amiss as the connector of the invention could be designed for any reasonable width of ribbon tape having however many electrical conductors are required for a specific application.

Figure 14:
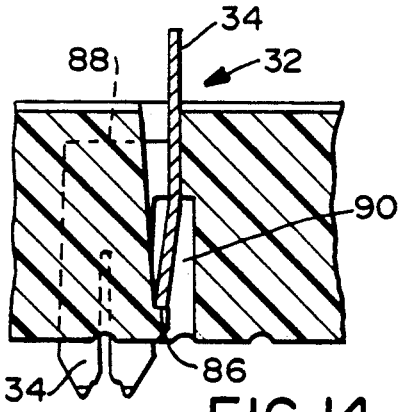
FIG. 14 is a fragmentary sectional side elevation of the FIG. 13 connecting element shown located in the floor of the connector housing.
Figure 13:
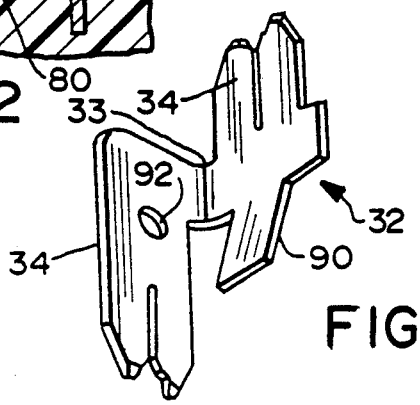
FIG. 13 is a perspective view of a second embodiment of the conductor connecting element of the invention.

The invention is not limited to the precise details as herein described. For example as an alternative to the conductor engaging elements 32 being molded into the floor 28 of the housing, the floor could include, as shown in FIG. 14, an L-shaped recess into which the elements 32 are pressed on completion of the plastics molding process. One of the legs of the L extends through the floor 28 and is shaped as shown in the drawing to include a step 86. The portion of the recess defining the outer leg of the L extends from the underside of the floor to terminate at 88 below the upper surface of the floor. The press in conductor engaging elements 32 in this application are modified from that of FIG. 4 in that they include a locking tang 90 which extends downwardly and inwardly from the base of one of the blades 34, as shown in FIG. 13, and a dimple 92 on the remaining blade 34. With the conductor engaging elements 32 held as shown in FIG. 13 they are pressed into the L-shaped recesses in the underside of the housing floor 28 until the upper blade 34 projects from the upper surface of the floor 28 and the lower edge of the locking tang engages over the recess step 86, as shown in FIG. 14, to lock the element 32 in the recess. The dimple 92 serves firmly to locate the other blade 34 in its recess against flexing in the recess.

Additionally, the conductor cutting blade 78 described with reference to FIGS. 11 and 12 could be fixed to the press member 44 in place of the floor 28 with the blade receiving recess located in the upper surface of the floor 28.

An alternate embodiment of the connector is identified generally by the numeral 100 in FIGS. 15–18. The connector 100 comprises a unitarily molded plastic housing 101. The housing 101 is constructed to receive a ribbon cable 102 having a plurality of discrete conductors 103 therein. A separate press member 104 is engageable with the housing 101 and is operative to terminate the conductors 103 of the ribbon cable 102 with terminals 105. Each terminal 105 includes a solder tail 106 or other such board connecting structure at one end and an insulation displacement structure 108 at the opposed end. A mounting portion 110 is disposed intermediate the opposed ends of the terminal 105 and is frictionally locked into the housing 101 as explained further herein. Thus the mounting portion 110 is surrounded and supported by a unitary matrix of plastic material. The relative dimensions of the mounting portion 110 and the terminal receiving aperture in the housing 101 are selected to provide positive support for the terminal 105 and ensure environmental sealing. The frictional mounting also accurately positions the terminals 105 to ensure that each insulation displacement structure 108 is aligned with a corresponding conductor 103 in the cable 102.

The housing 101 of the connector 100 includes a generally rectangular bottom wall 112, a pair of upstanding substantially parallel end walls 114 and 116 and opposed substantially parallel upstanding front and rear walls 118 and 120 which are connected to and extend orthogonally between the end walls 114 and 116. The top 122 of the housing 101 is substantially opened to define a termination cavity 124 into which the ribbon cable 102 is received and terminated as explained further below. The intermediate mounting portion 110 of each terminal 105 is frictionally retained in correspondingly dimensioned apertures 113 in the bottom wall 112 such that the insulation displacement structure 108 is disposed in the cavity 124. The relative dimensions of the mounting portion 110 of the terminal 105 and the apertures 113 in the bottom wall 112 prevents moisture from migrating into the cavity 124 from the lower exterior of the housing 101. Moisture and containment protection also is provided by a sealing grease 125.

Portions of the front wall 118 generally adjacent the top 122 of the housing 101 include a slot 126 dimensioned to slidably receive one end of the ribbon cable 102 therein. Interior portions of the front wall 118 in line with the cable slot 126 are defined by a ramped cable support surface 128 which is configured to closely engage the cable 102 after termination. The front wall 118 of the housing 101 is further characterized by a pair of elongated locking slots 129 and 130 which lie in a common plane and which contribute to the locking of the press member 104 in the housing 101. The cable slot 126 and the locking slots 129 and 130 provide a controlled path for flow of the sealing grease 125 for environmentally sealing the connector after termination, and, if desired, during a preload condition of the press member 104 in the housing 101.

Figure 16:
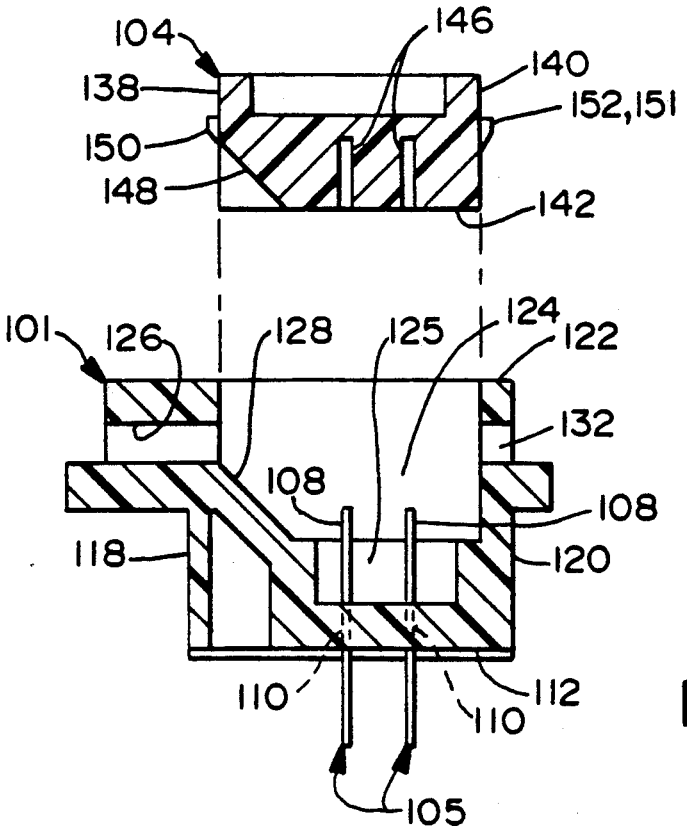
FIG. 16 is a cross-sectional view taken along line 16—16 in FIG. 15.

With further reference to FIG. 16, it will be noted that the flowable sealing grease 125 is deposited in the portion of the termination cavity 124 adjacent the bottom wall 122. The flowable sealing grease 125 may be a silicone that will seal areas of the termination cavity 124 in proximity to the terminals 105 as explained below. The volume of the sealing grease 125 is selected to be slightly in excess of the amount needed to fill all voids after termination as explained and shown below.

Figure 15:
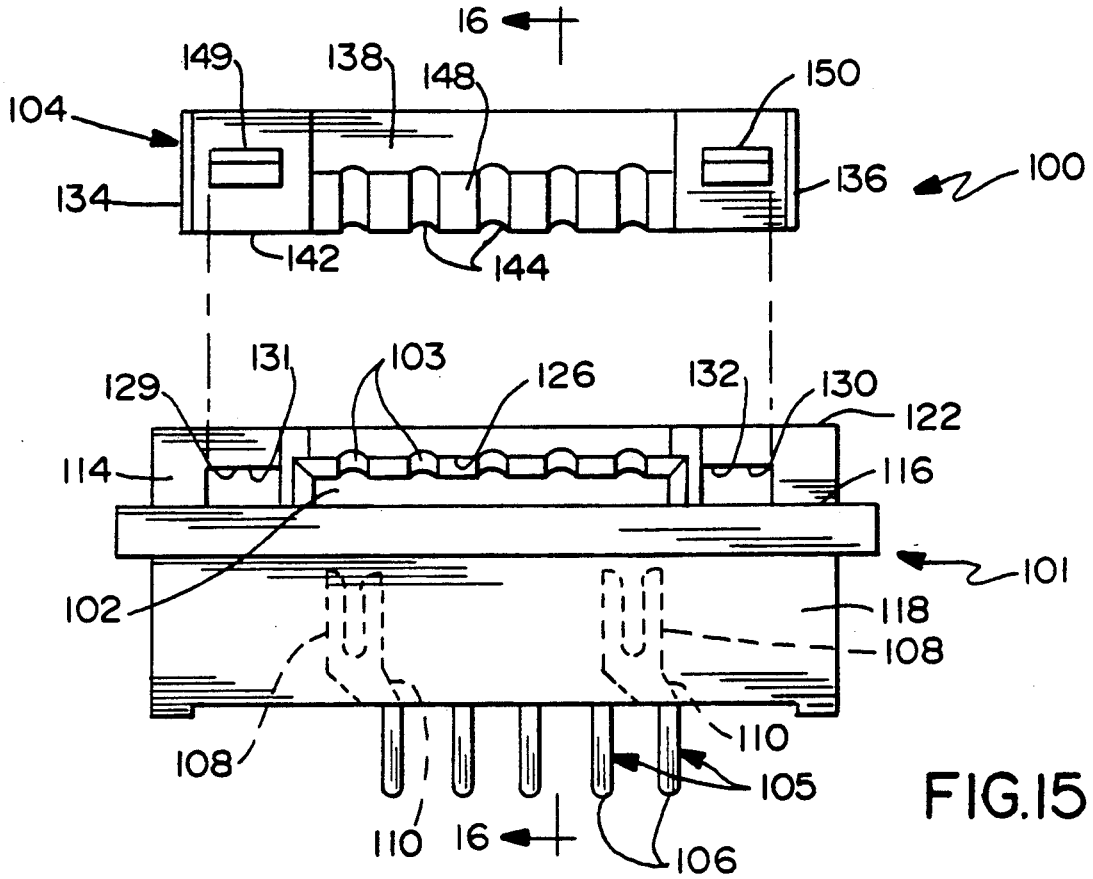
FIG. 15 is an exploded front elevational view of an alternate housing and press member.

The press member 104, as shown most clearly in FIGS. 15 and 16, is of a substantially rectangular configuration dimensioned to be closely telescopingly received within the termination cavity 124 of the housing 01. More particularly, the press member 104 includes opposed end surfaces 134 and 136 which are parallel to one another and are disposed to slidably engage the end walls 114 and 116 of the housing 101. Similarly, the press member 104 includes opposed front and rear surfaces 138 and 140 which are disposed to be in sliding engagement with the front and rear walls 118 and 120 of the housing 101. The lower face 142 of the press member 104 corresponds generally in shape to the surface configuration of the ribbon cable 102, including grooves 144 for securely engaging regions of the cable 102 defined by the conductors 103 therein and for positively urging the conductors into the insulation displacement structure on each respective terminal 105. The lower face 142 is further characterized by slots 146 for receiving the insulation displacement ends 108 on the respective terminals 105. The press member 104 further includes a ramped press surface 148 extending angularly between the front face 138 thereof and the lower face 142. The ramped press surface 148 defines an angle substantially conforming to the ramped support surface 128 in the housing 101 such that the ribbon cable 102 is securely engaged therebetween after termination for preventing pull-out of the cable 102.

Figure 17:
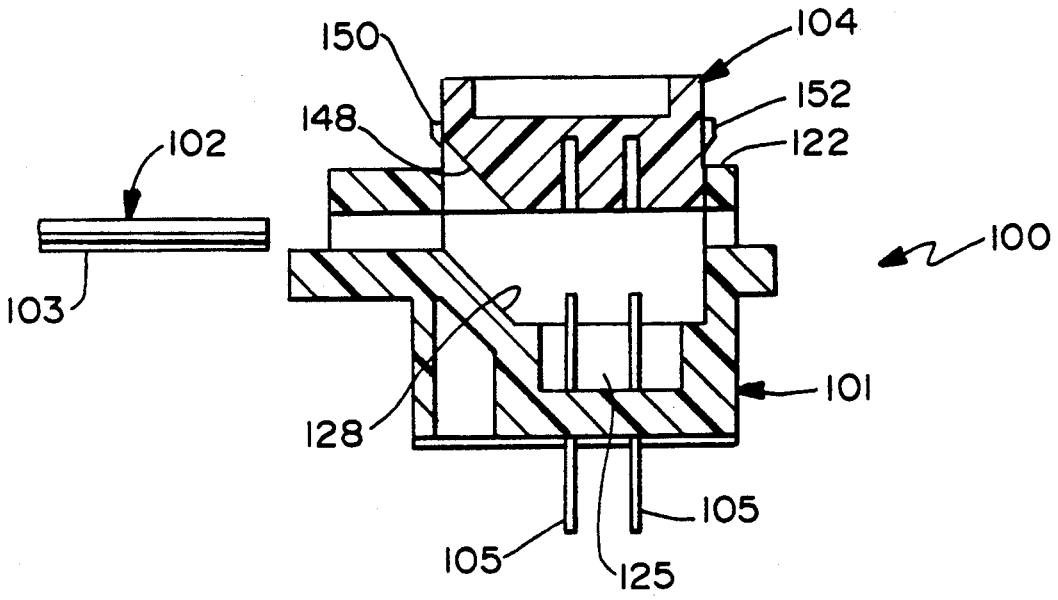
FIG. 17 is a cross-sectional view similar to FIG. 16, but showing the press member partly inserted in the housing.

The press member 104 is further characterized by elongated locking ridges 149 and 150 which extend from the front face 138 and engage the locking slots 129 and 130 in the front wall 118 of the housing 101. The rear face 140 of the press member 104 is characterized by small interference structures 151 and 152 for engaging the rear wall 120 of the housing 101. The elongated locking ridges 9 and 150 and the interference structures 151 and 152 may be disposed to lie substantially in a common plane to prevent skewing of the press member 104 in the housing 10 prior to termination. In use, the terminals 105 are frictionally mounted in the apertures 113 in the bottom wall 112 of the housing 01. The silicone sealing grease 125 is then deposited in the termination cavity 124 to surround the terminals 105 in proximity to the bottom wall 112. The press member 104 is then frictionally mounted in the pre-load condition in the housing 101 as depicted in FIG. 17. The locking ridges 149 and 150 and the small interference structures 151 and 152 function to prevent skewing of the press member 104 in the housing 101 in the pre-load condition.

The ribbon cable 102 is slidably inserted into the slot 126 in the front wall 118 of the housing 101 a sufficient distance such that the end of the ribbon cable 102 abuts the rear wall 120 of the housing 101. In this initial position, the ribbon cable 102 will be spaced above the terminals 105 and the sealing grease 125, as shown in FIG. 16.

Figure 18:
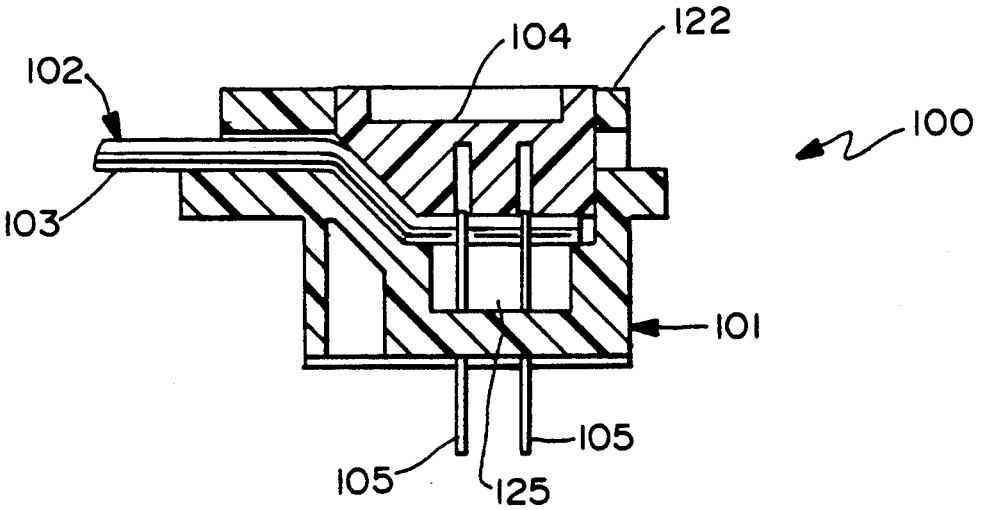
FIG. 18 is a cross-sectional view similar to FIG. 17, but showing the press member fully seated in the housing.

As shown in FIG. 18, termination is achieved by application tooling to urge the press member 104 fully into the termination cavity 124 of the housing 101. In this fully seated condition, the lower face 142 of the press member 104 will urge the ribbon cable 102 into the insulation displacement structure 108 on the respective terminals 105 for achieving efficient electrical connection with the conductors 103 in the ribbon cable 102. The locking ridges 149 and 150 of the press member 104 will be snapped into locking engagement with the respective locking slots 129 and 130 respectively of the housing 101. The close telescoping fit of the press member 104 in the base 101 will prevent skewing of the press member 104 during termination, and will thereby ensure that all conductors 103 of the ribbon cable 102 are terminated simultaneously. The movement of the press member 104 into the locked position in the housing 101 will further ensure that the sealing grease 125 occupies all voids in the termination cavity 124 of the housing 101, with excess flowing out of the locking slots 129 and 130 and the cable slot 126.

As illustrated most clearly in FIG. 18, the upper face of the press member 104 is substantially flush with the upper face 122 of the housing 101 in the fully seated condition of the press member 104. In this condition, inadvertent contact that conceivably could dislodge the press member 104 is positively avoided. Furthermore, the connector 100 is provided with a very low profile.

While the invention has been described with respect to certain preferred embodiments, it is apparent that various changes can be made without departing from the scope of the invention as defined by the appended claims.

What is claimed is:

1. An electrical connector for electrical connection to each of a plurality of discrete conductors in a ribbon cable, said connector comprising:

a housing unitarily molded from a nonconductive material and having a bottom wall and a plurality of interconnected side walls extending upwardly from the bottom wall to define an open topped termination cavity, one of said upstanding side walls including an elongated cable slot for slidably receiving an end of the ribbon cable therein, a plurality of said upstanding side walls being characterized by elongated locking structures lying substantially in a common plane;

a plurality of terminals having mounting portions frictionally secured in the bottom wall of the housing such that each said mounting portion is surrounded and supported by a unitary matrix of nonconductive material, each said terminal having insulation displacement structure disposed in the termination cavity for electrical connection with one of said conductors in the ribbon cable; and, a press member having a bottom face configured for urging the ribbon cable into the insulation displacement structure of the respective terminals in the termination cavity of the housing, said press member further comprising a plurality of side faces for sliding frictional engagement with the side walls of the housing such that the press member is frictionally retained in the housing in a first position where the bottom face of the ribbon cable is spaced from the terminals of the housing and such that the press member is slidably movable into a second position where the bottom face of the press member urges the conductors of the ribbon cable into the insulation displacement structure of the terminals in the housing, said press member further comprising a plurality of coplanar locking structures disposed and dimensioned for locking engagement with the locking structures of the housing, whereby the coplanar alignment of the locking structures of the housing and the press member prevents skewing of the press member and the cable prior to and during termination.

2. A connector as in claim 1 wherein the housing and the press member each comprise upper faces, said press member being dimensioned such that the upper face thereof is substantially flush with the upper face of the housing upon movement of the press member into the second position in the housing.

3. A connector as in claim 1 wherein the locking structures of the housing define a plurality of slots, and wherein the locking structures of the press member define a plurality of ridges.

4. A connector as in claim 1 wherein portions of the termination cavity adjacent the cable slot define a ramped cable support surface configured to closely engage the cable, said press member including a ramped press surface disposed such that the cable is securely engaged between the ramped cable support surface of the housing and the ramped press surface of the press member when the press member is in the second position in the housing.

5. A connector as in claim 1 wherein the housing is generally rectangular and includes substantially parallel front and rear walls and substantially parallel first and second end walls extending orthogonally between the front and rear walls, the press member defining a substantially rectangular configuration generally corresponding to the housing and including opposed substantially parallel front and rear faces for sliding engagement with the front and rear walls of the housing and opposed substantially parallel first and second end faces for sliding engagement with the end walls of the housing.

6. A connection as in claim 5 wherein the locking structures are formed in the front wall of the housing and wherein the locking structures of the press member are disposed on the front face thereof for locking engagement with the locking structures in the housing, and wherein the rear face of the press member includes interference structures for engaging the real wall of the housing.

7. A connector as in claim 1 further comprising a flowable sealing grease disposed in the termination cavity of the housing and substantially surrounding at least portions of the terminals therein, the sealing grease in the housing defining a volume sufficient to surround the ribbon cable after termination with the terminals in the housing.

8. A connector as in claim 7 wherein the locking structures of the housing define slots extend entirely through at least one side wall of the housing, said slots being disposed to define passages for excess sealing grease flowing int the housing during termination of the ribbon cable.

* * * * *